US009728306B2

(12) United States Patent
Lu et al.

(10) Patent No.: US 9,728,306 B2
(45) Date of Patent: Aug. 8, 2017

(54) MICRO-RESISTANCE STRUCTURE WITH HIGH BENDING STRENGTH, MANUFACTURING METHOD AND SEMI-FINISHED STRUCTURE THEREOF

(71) Applicant: Viking Tech Corporation, Hsinchu County (TW)

(72) Inventors: Chi-Yu Lu, Hsinchu County (TW); Chien-Ming Shao, Hsinchu County (TW); Chien-Chung Yu, Hsinchu County (TW); Guan-Min Zeng, Hsinchu County (TW)

(73) Assignee: VIKING TECH CORPORATION, Hsinchu County (TW)

( * ) Notice: Subject to any disclaimer, the term of this patent is extended or adjusted under 35 U.S.C. 154(b) by 76 days.

(21) Appl. No.: 14/819,210

(22) Filed: Aug. 5, 2015

(65) Prior Publication Data

US 2016/0064122 A1 Mar. 3, 2016

(30) Foreign Application Priority Data

Sep. 3, 2014 (TW) ..... 103130450 A

(51) Int. Cl.
*H01C 3/06* (2006.01)
*H01C 1/028* (2006.01)
*H01C 17/02* (2006.01)

(52) U.S. Cl.
CPC ..... *H01C 1/028* (2013.01); *H01C 17/02* (2013.01)

(58) Field of Classification Search
CPC ..... H01C 1/028; H01C 17/02
USPC ..... 338/22 R, 210
See application file for complete search history.

(56) References Cited

U.S. PATENT DOCUMENTS 6,317,023 B1 * 11/2001 Felten ..... H05K 1/162 174/259
6,794,980 B2 * 9/2004 Chu ..... H01C 7/13 338/210
6,860,000 B2 * 3/2005 Felten ..... H01C 7/003 174/259
7,248,142 B2 * 7/2007 Beck ..... H01C 10/12 338/114
8,044,763 B2 * 10/2011 Wang ..... H01C 1/1406 338/22 R
8,896,409 B2 * 11/2014 Okinaka ..... H01C 7/10 338/21
8,902,039 B2 * 12/2014 Suzuki ..... H01C 1/14 338/21

(Continued)

*Primary Examiner* — Kyung Lee
(74) *Attorney, Agent, or Firm* — Muncy, Geissler, Olds & Lowe, P.C.

(57) ABSTRACT

A micro-resistance structure with high bending strength is disclosed. The micro-resistance structure with high bending strength comprises a multi-layer metallic substrate; a patterned electrode layer disposed on a lower surface of the multi-layer metallic substrate; an encapsulant layer covering a portion of the multi-layer metallic substrate, wherein the encapsulant layer is substantially made of a flexible resin ink; and two external electrodes, which are electrically insulated from each other, covering the exposed portion of the multi-layer metallic substrate. The abovementioned structure is characterized in high bendability and applicable to wearable devices. A manufacturing method and a semi-finished structure of the micro-resistance structure with high bending strength are also disclosed herein.

19 Claims, 6 Drawing Sheets

(56) References Cited

U.S. PATENT DOCUMENTS

| | | | | |
|---|---|---|---|---|
| 9,007,166 | B2 * | 4/2015 | Tseng | H01C 7/02 338/22 R |
| 2002/0130757 | A1 * | 9/2002 | Huang | H01C 1/1406 338/22 R |
| 2007/0075823 | A1 * | 4/2007 | Sugiyama | H01C 1/14 338/22 R |
| 2013/0025915 | A1 * | 1/2013 | Lin | B32B 37/02 174/254 |
| 2015/0211940 | A1 * | 7/2015 | Miura | H01C 7/02 429/61 |

* cited by examiner

MICRO-RESISTANCE STRUCTURE WITH HIGH BENDING STRENGTH, MANUFACTURING METHOD AND SEMI-FINISHED STRUCTURE THEREOF

BACKGROUND OF THE INVENTION

1. Field of the Invention

The present invention relates to a chip resistor, particularly to a micro-resistance structure with high bending strength, a manufacturing method thereof and a semi-finished structure thereof.

2. Description of the Prior Art

Owing to advance of science and technology, flexible display devices and wearable devices are emerging with the elements thereof required to be slim, compact and lightweight. Flexible elements have higher bending strength and thus can apply to flexible display devices and wearable devices, which require bendability.

Refer to FIG. 1 for a conventional chip resistor. The conventional chip resistor 1 comprises an insulating aluminum oxide-based ceramic material 11, a front conductor 12, a rear conductor 13, a resistor 14, a glass protector 15, a resin protector 16, a side film electrode 17, a nickel layer 18, and a tin layer 19. The main element of the conventional chip resistor 1 is the insulating aluminum oxide-based ceramic material 11, which is hard and brittle, and whose maximum bendability is normally below 3 mm in a flexural test. In a more crucial bending test of a circuit board having chip resistors, fractures of the chip resistors are likely to occur and cause the circuit board to fail.

SUMMARY OF THE INVENTION

The present invention provides a micro-resistance structure with high bending strength, a manufacturing method thereof, and a semi-finished structure thereof, wherein a flexible resin ink is used to form an encapsulant layer for protecting the micro-resistance structure, and wherein inner electrodes are formed before formation of the patterns of an alloy layer and a metal layer, whereby the bendability of the micro-resistance structure is effectively increased, and whereby the fabrication efficiency is significantly promoted.

One embodiment of the present invention proposes a method for manufacturing a micro-resistance structure with high bending strength, which comprises steps: providing a multi-layer metallic substrate including an alloy layer, a resin layer disposed on an upper surface of the alloy layer, and a metal layer disposed on the resin layer; forming an array of a patterned electrode layer on a lower surface of the alloy layer; removing a portion of the multi-layer metallic substrate to form a plurality of micro-resistance units, which are partially separated from each other, wherein in each micro-resistance unit, the patterned electrode layer is defined to be a first electrode region and a second electrode region, which are separated from each other, and the metal layer includes a first metal region and a second metal region; forming an upper encapsulant layer covering a portion of the first metal region and a portion of the second metal region, and forming a lower encapsulant layer covering a portion of the alloy layer, wherein at least one of the upper encapsulant layer and the lower encapsulant layer is substantially made of a flexible resin ink; undertaking a stamping process to form a plurality of micro-resistance structures, which are separated from each other; and undertaking an electroplating process to form in the micro-resistance structure two external electrodes, which are electrically insulated from each other.

Another embodiment of the present invention proposes a semi-finished structure of a micro-resistance structure with high bending strength, which comprises a multi-layer metallic substrate and a patterned electrode layer, wherein the multi-layer metallic substrate includes an alloy layer, a resin layer and a metal layer, and wherein the resin layer is disposed on an upper surface of the alloy layer, and wherein the metal layer is disposed on the resin layer, and wherein the array of the patterned electrode layer is disposed on a lower surface of the alloy layer; and at least one sub-metal layer disposed inside said resin layer.

A further embodiment of the present invention proposes a micro-resistance structure with high bending strength, which comprises a multi-layer metallic substrate structure, a patterned electrode layer, an upper encapsulant layer, a lower encapsulant layer and two external electrodes electrically insulated from each other, wherein the multi-layer metallic substrate structure includes an alloy layer, a resin layer and a metal layer. The resin layer is disposed on an upper surface of the alloy layer. The metal layer is disposed on the resin layer and includes first a metal region and a second metal region. The patterned electrode layer is disposed on a lower surface of the alloy layer and defined to be a first electrode region and a second electrode region, which are separated from each other. The upper encapsulant layer covers a portion of the first metal region and a portion of the second metal region. The lower encapsulant layer covers a portion of the alloy layer and reveals the first electrode region and the second electrode region. At least one of the upper encapsulant layer and the lower encapsulant layer is substantially made of a flexible resin ink. One of two electrically-insulated external electrodes covers the exposed first metal region and the first electrode region; the other one of two electrically-insulated external electrodes covers the exposed second metal region and the second electrode region; and at least one sub-metal layer disposed inside said resin layer.

Below, embodiments are described in detail in cooperation with the attached drawings to make easily understood the objectives, technical contents, characteristics and accomplishments of the present invention.

BRIEF DESCRIPTION OF THE DRAWINGS

FIG. 4A, FIG. 4B-1, FIG. 4*b*-2, FIG. 4C-1, FIG. 4C-2, FIG. 4D-1, FIG. 4D-2, and FIG. 4E are diagrams schematically the steps (the semi-finished structures of the steps) of manufacturing a micro-resistance structure with high bending strength according to one embodiment of the present invention.

DESCRIPTION OF THE PREFERRED EMBODIMENT

Figure 1:
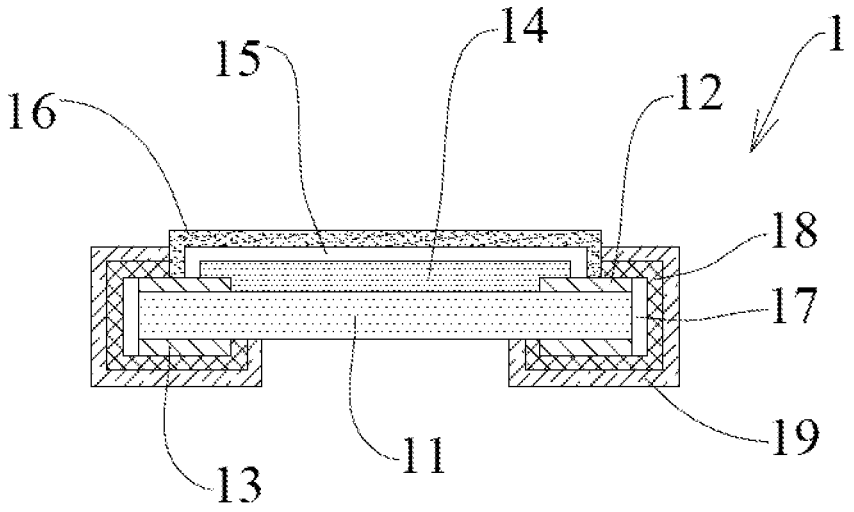
Fig.1 (prior art)
FIG. 1 is a sectional view schematically showing a conventional chip resistor.

The present invention provides a micro-resistance structure with high bending strength, a manufacturing method thereof, and a semi-finished structure thereof. The micro-resistance structure comprises a multi-layer metallic substrate, a patterned electrode layer, an upper encapsulant layer, a lower encapsulant layer, and two external electrodes electrically insulated from each other. At least one of the upper encapsulant layer and the lower encapsulant layer is substantially made of a flexible resin ink. The flexible resin ink not only can protect the resistance structure but also can effectively increase the bending strength of the micro-resistance. Further, the fabrication efficiency is significantly promoted via forming the inner electrodes before formations of the patterns the alloy layer and the metal layer. The micro-resistance structure of the present invention includes but is not limited to Size 2512 (0.25 in×0.12 in (6.3 mm×3.1 mm)). The present invention will be described in detail with embodiments below. However, these embodiments are only to exemplify the present invention but not to limit the scope of the present invention. In addition to the embodiments described in the specification, the present invention also applies to other embodiments. Further, any modification, variation, or substitution, which can be easily made by the persons skilled in that art according to the embodiment of the present invention, is to be also included within the scope of the present invention, which is based on the claims stated below. Although many special details are provided herein to make the readers more fully understand the present invention, the present invention can still be practiced under a condition that these special details are partially or completely omitted. Besides, the elements or steps, which are well known by the persons skilled in the art, are not described herein lest the present invention be limited unnecessarily. Similar or identical elements are denoted with similar or identical symbols in the drawings. It should be noted: the drawings are only to depict the present invention schematically but not to show the real dimensions or quantities of the present invention. Besides, matterless details are not necessarily depicted in the drawings to achieve conciseness of the drawings.

Figure 2A:
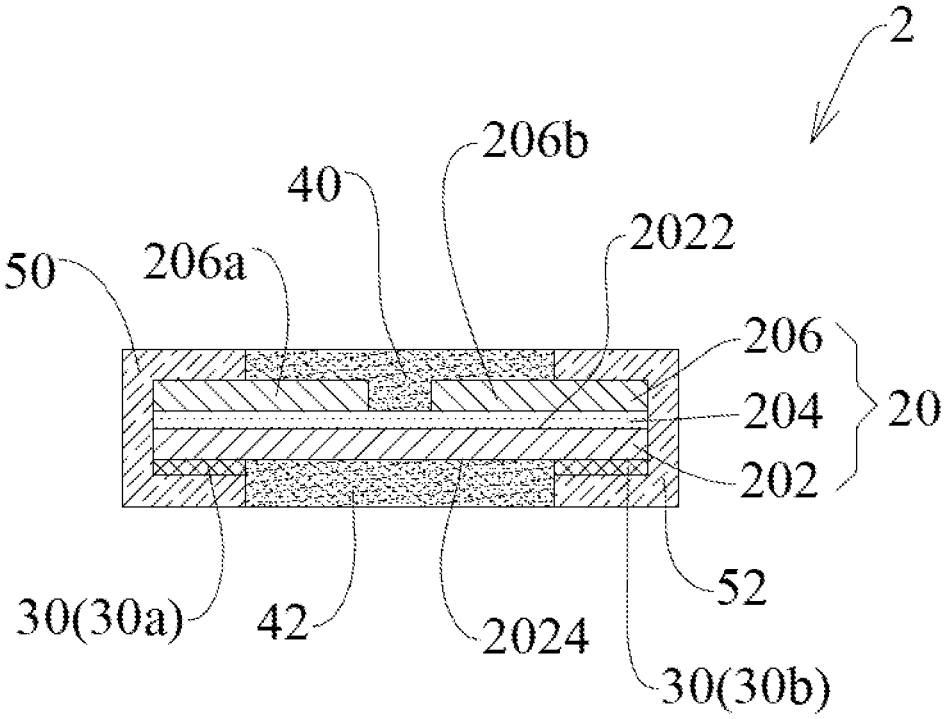
FIG. 2A, FIG. 2B and FIG. 2C are sectional views respectively schematically showing micro-resistance structures with high bending strength according to different embodiments of the present invention.

Refer to FIG. 2A a sectional view schematically showing a micro-resistance structure according to one embodiment of the present invention. The micro-resistance structure 2 of the present invention comprises a multi-layer metallic substrate structure 20, a patterned electrode layer 30, an upper encapsulant layer 40, a lower encapsulant layer 42, and two external electrodes 50 and 52, which are electrically insulated from each other. The multi-layer metallic substrate structure 20 includes an alloy layer 202, a resin layer 204, and a metal layer 206. The resin layer 204 is disposed on an upper surface 2022 of the alloy layer 202; the metal layer 206 is disposed on the resin layer 204. The metal layer 206 further includes a first metal region 206*a* and a second metal region 206*b*. In one embodiment, the alloy layer 202 is made of a nickel-copper alloy, a manganese-copper alloy, or a nickel-chromium alloy; the metal layer 206 is made of copper or aluminum. The patterned electrode layer 30 is disposed on a lower surface 2024 of the alloy layer 202. The patterned electrode layer 30 is defined to be a first electrode region 30*a* and a second electrode region 30*b*, which are separated from each other and function as inner electrodes of the micro-resistance structure 2. The upper encapsulant layer 40 covers a portion of the first metal region 206*a* and a portion of the second metal region 206*b*; the lower encapsulant layer 42 covers a portion of the alloy layer 202 and reveals the first electrode region 30*a* and the second electrode region 30*b*. At least one of the upper encapsulant layer 40 and the lower encapsulant layer 42 is substantially made of a flexible resin ink. In one embodiment, the flexible resin ink is selected from a group including a silicone resin ink, an epoxy resin ink, and mixtures of a silicone resin ink and an epoxy resin ink. The external electrode 50 covers the exposed first metal region 206*a* and the first electrode region 30*a*; the external electrode 52 covers the exposed second metal region 206*b* and the second electrode region 30*b*. In one embodiment, the external electrode 50 is electrically connected with the first metal region 206*a* and the first electrode region 30*a*; the external electrode 52 is electrically connected with the second metal region 206*b* and the second electrode region 30*b*. The encapsulant layer made of the flexible resin ink features flexibility and provides superior bendability for the micro-resistance structure 2. In one embodiment, the bending depth of the micro-resistance structure 2 reaches as high as 2-10 mm. The bending depth is defined as the depth of the center of the micro-resistance structure 2 while the micro-resistance structure 2 is bent by applying force to the center thereof with two sides thereof supported. Refer to Table.1 and Table.2. Table.1 shows the relationship of the bending depths and the impedance variations of the conventional ceramic chip resistor and the micro-resistance structure according to one embodiment of the present invention. Table.2 shows the relationship of the bending depths and the appearance variations of the conventional ceramic chip resistor and the micro-resistance structure according to one embodiment of the present invention. Table.1 and Table.2 indicate that the conventional ceramic chip resistor is likely to fracture while the bending depth exceeds 4 mm and that the micro-resistance structure of the present invention functions well although the bending depth has reached 10 mm. Therefore, the micro-resistance structure of the present invention can indeed meet the requirement of flexible display devices and wearable devices.

TABLE 1 a relationship of bending depths and impedance variations

| | Relationship of Bending Depths and Impedance Variations | | | | | | | | |
|---|---|---|---|---|---|---|---|---|---|
| | 2 mm | 3 mm | 4 mm | 5 mm | 6 mm | 7 mm | 8 mm | 9 mm | 10 mm |
| Conventional | 0.08% | 0.15% | 0.15% | OPEN | OPEN | OPEN | OPEN | OPEN | OPEN |
| the Present Invention | 0.07% | 0.12% | 0.14% | 0.16% | 0.19% | 0.21% | 0.26% | 0.29% | 0.33% |

TABLE 2

| a relationship of bending depths and appearance variation | | | | | | | | | |
|---|---|---|---|---|---|---|---|---|---|
| | Relationship of Bending Depths and Appearance Variations | | | | | | | | |
| | 2 mm | 3 mm | 4 mm | 5 mm | 6 mm | 7 mm | 8 mm | 9 mm | 10 mm |
| Conventional | fine | fine | break | break | break | break | break | break | break |
| the Present Invention | fine | fine | fine | fine | fine | fine | fine | fine | fine |

Figure 2B:
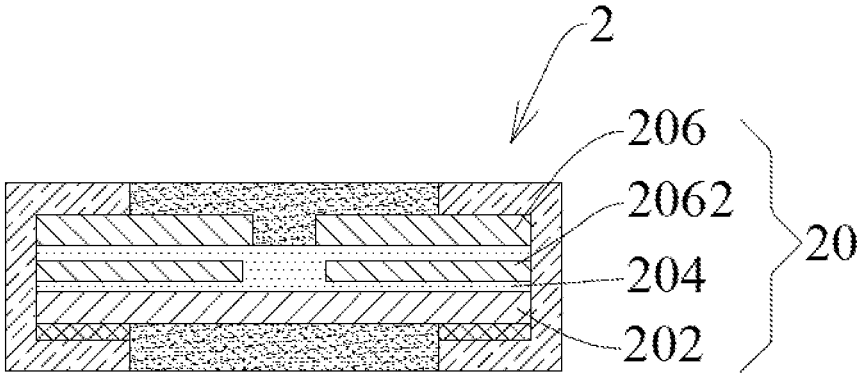
Figure 2C:
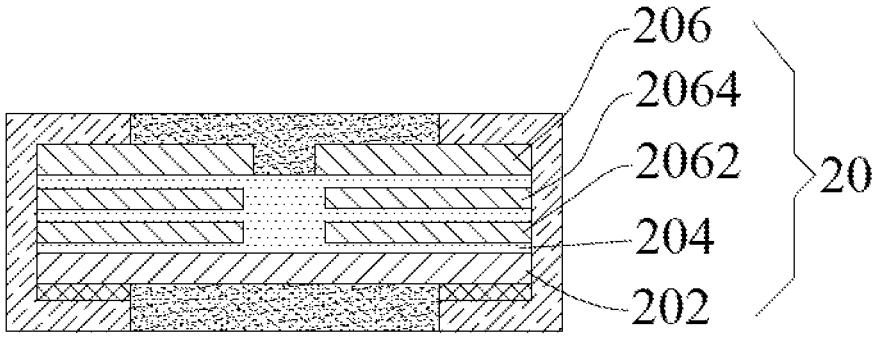
Figure 2D:
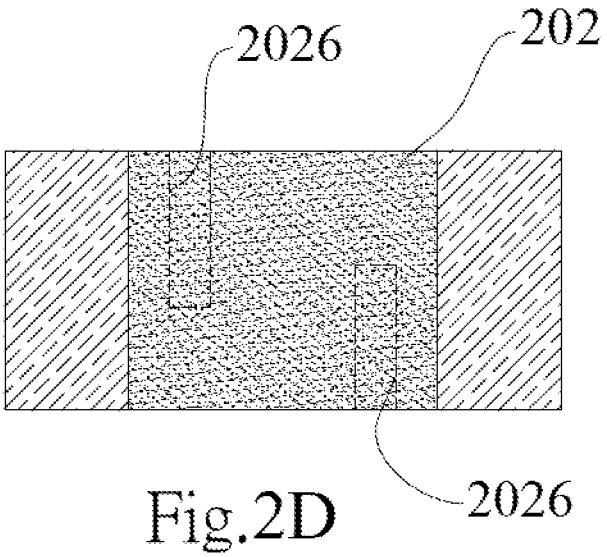
FIG. 2D is a bottom view schematically showing the structure of an alloy layer of a micro-resistance structure with high bending strength according to one embodiment of the present invention.

In the present, the metal layer 206 includes but is not limited to be the structure shown in FIG. 2A. Refer to FIG. 2B and FIG. 2C. In one embodiment, the multi-layer metallic substrate 20 further includes at least one of sub-metal layers 2062 and 2064, which are disposed inside resin layer 204 and stacked below the metal layer 206, whereby to increase the heat-dissipation performance of the micro-resistance structure. Refer to FIG. 2D. In one embodiment, the alloy layer 202 further includes at least one breach 2026 extending from the boundary to the center of the alloy layer 202, wherein the breaches 2026 parallel extend alternately from the right boundary and the left boundary of the alloy layer 202. In the present invention, the area of the alloy layer 202 is changed to vary the length of the current path and adjust the resistance value.

Figure 3:
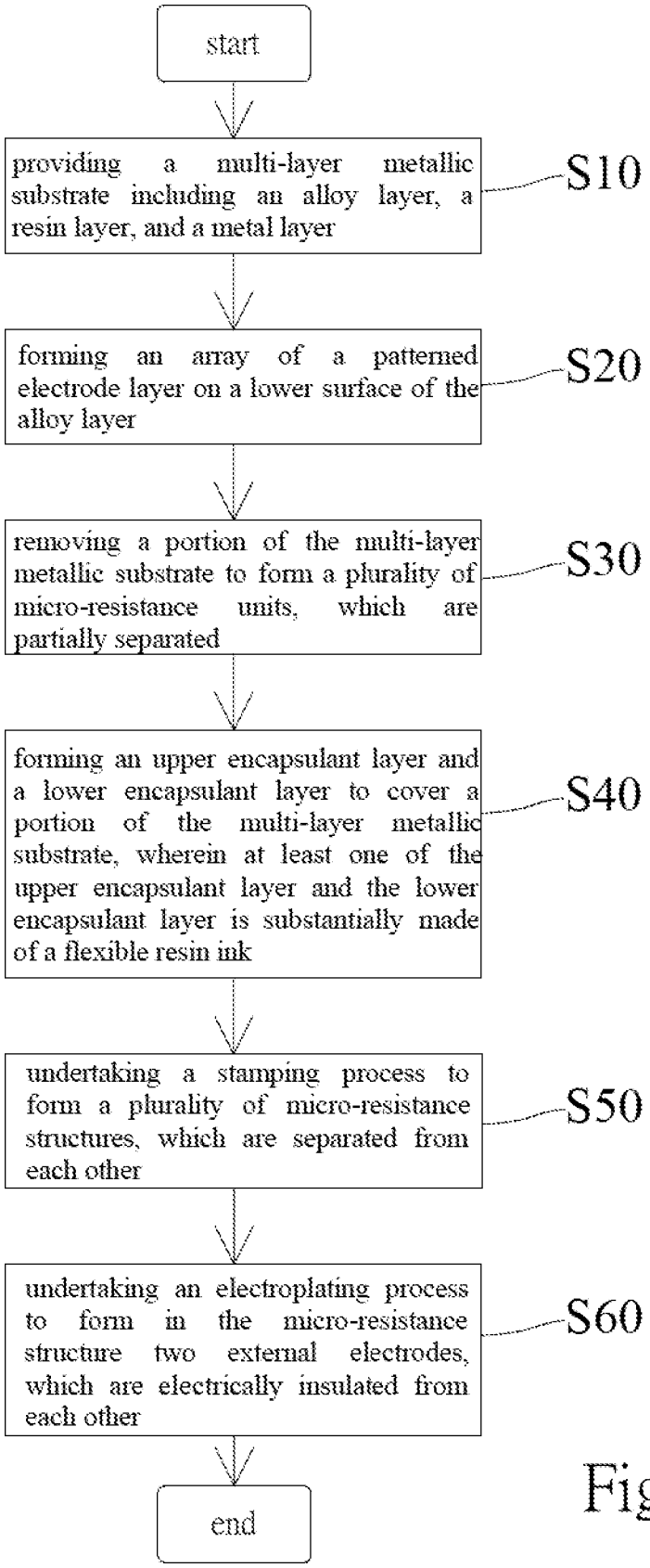
FIG. 3 is a flowchart of a method for manufacturing a micro-resistance structure with high bending strength according to one embodiment of the present invention.
Figure 4A:
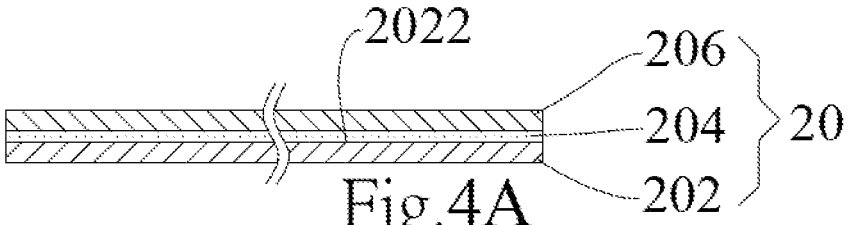
Figures 1, 4B:
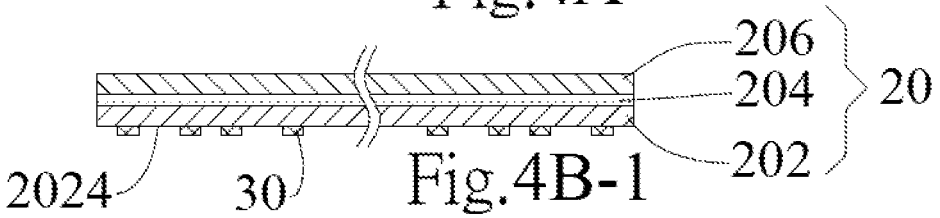
Figures 2, 4B:
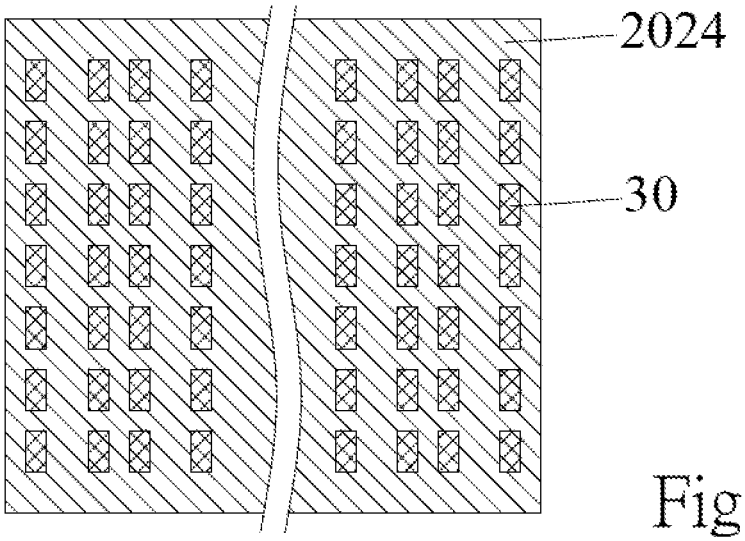

Refer to FIG. 3 and FIGS. 4A-4E. FIG. 3 is a flowchart of a method for manufacturing a micro-resistance structure with high bending strength according to one embodiment of the present invention. FIGS. 4A-4E are diagrams schematically showing steps (semi-finished structures) of a method for manufacturing a micro-resistance structure with high bending strength according to one embodiment of the present invention. In Step S10, provide a multi-layer metallic substrate 20, wherein the multi-layer metallic substrate structure 20 includes an alloy layer 202, a resin layer 204, and a metal layer 206, and wherein the resin layer 204 is disposed on an upper surface 2022 of the alloy layer 202, and the metal layer 206 is disposed on the resin layer 204, as shown in FIG. 4A. In one embodiment, the multi-layer metallic substrate 20 is fabricated into an integral body with a hot-pressing technology. In Step S20, form an array of a patterned electrode layer 30 on a lower surface 2024 of the alloy layer 202. The semi-finished structure of Step S20 is shown in FIG. 4B-1 and FIG. 4B-2, which are respectively a sectional view and a bottom view of the semi-finished structure. In one embodiment, the patterned electrode layer 30 is fabricated with an electroplating method.

Figures 1, 4C:
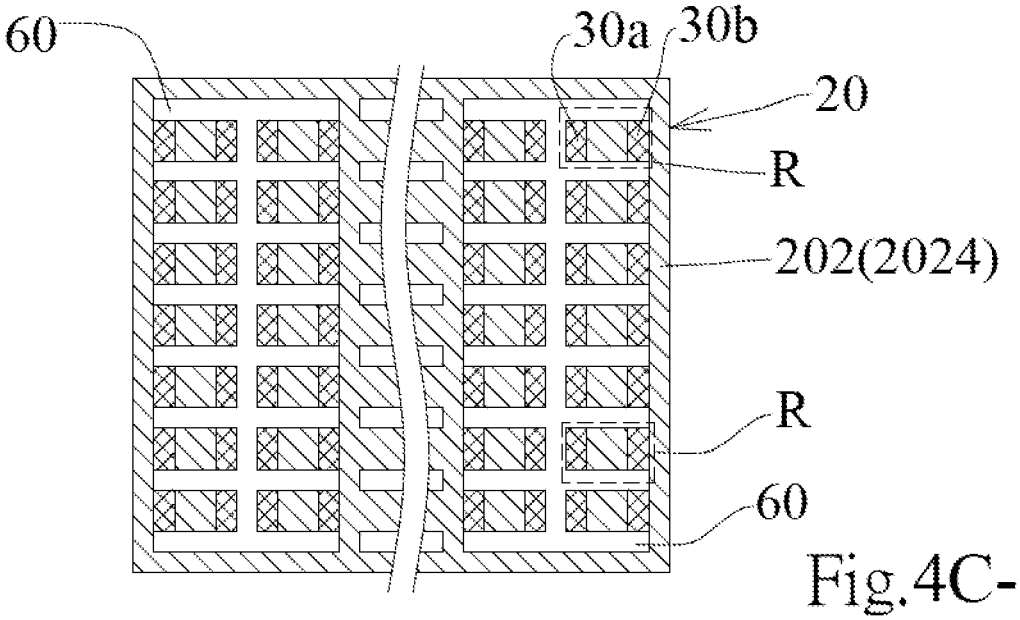
Figures 2, 4C:
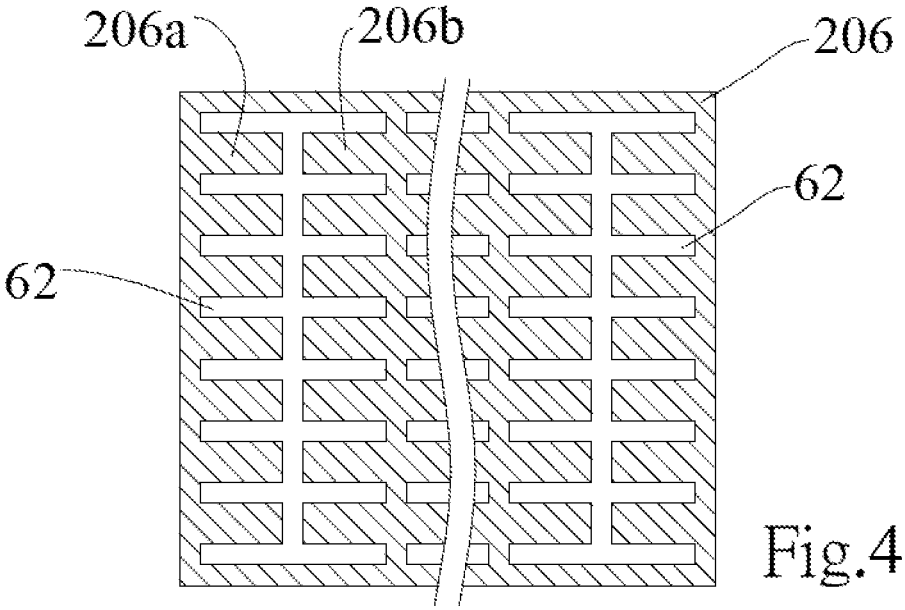
Figures 1, 4D:
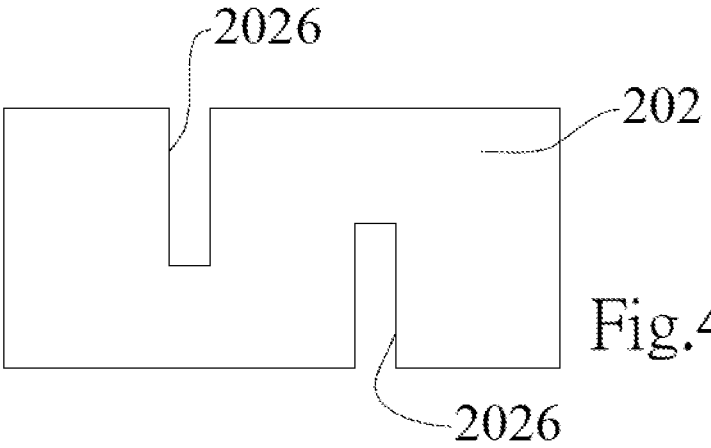
Figures 2, 4D:
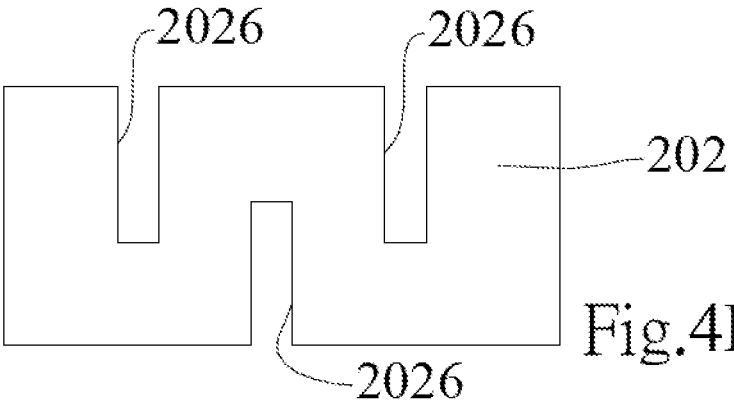

In Step S30, remove a portion of the multi-layer metallic substrate 20 to form a plurality of micro-resistance units R, which are partially separated, as shown in FIG. 4C-1. In each micro-resistance unit R, the patterned electrode layer 30 is defined to be a first electrode region 30*a* and a second electrode region 30*b*, which are separated from each other. The metal layer 206 further includes a first metal region 206*a* and a second metal region 206*b*, as shown in FIG. 4C-2. For example, in Step S30, a portion of the alloy layer 202 is removed from bottom of the multi-layer metallic substrate 20 to form a plurality of micro-resistance units R, which are partially separated; a portion of the metal layer 206 is removed from the top of the multi-layer metallic substrate 20 to form a first metal region 30*a* and a second metal region 30*b* in each micro-resistance unit R. In one embodiment, an etching method is used to remove a portion of the metal layer 206 and a portion of the alloy layer 202 simultaneously. In one embodiment, the step of removing a portion of the alloy layer 202 further includes forming at least one breach 2026 in each micro-resistance unit R; each breach 2026 extends from the boundary to the center of the alloy layer 206, wherein the breaches 2026 parallel extend alternately from the left boundary and right boundary of the alloy layer 206, as shown in FIG. 4D-1 and FIG. 4D-2. The semi-finished structure of Step S30 is shown in FIG. 4C-1 and FIG. 4C-2, which are respectively a bottom view and a top view of the semi-finished structure. As shown in FIG. 4C-1, a plurality of first perforated regions 60 is fabricated in a portion of the alloy layer 202 to form a plurality of micro-resistance units R, which are partially separated from each other, wherein in each micro-resistance unit R, the patterned electrode layer 30 is defined to be a first electrode region 30*a* and a second electrode region 30*b*, which are separated from each other. As shown in FIG. 4C-2, a plurality of second perforated regions 62 is fabricated in a portion of the metal layer 206 to form a first metal region 206*a* and a second metal region 206*b* in each micro-resistance R.

Figure 4E:
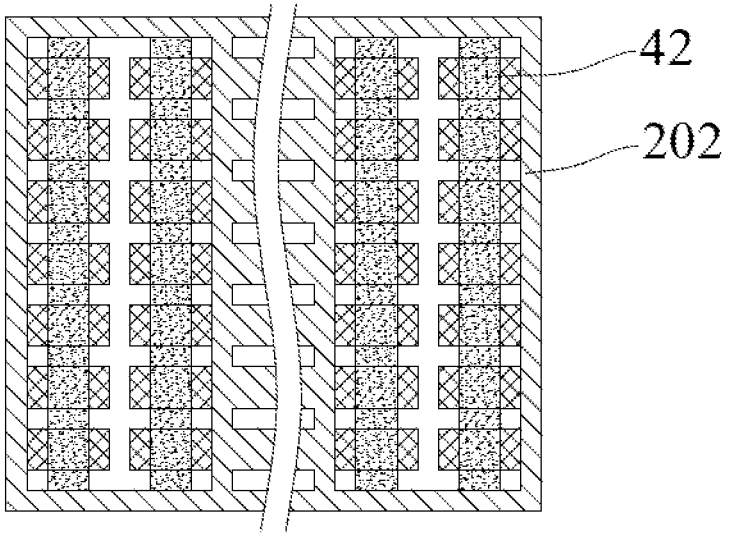

Refer to FIG. 2A and FIG. 4E. In Step S40, form an upper encapsulant layer 40 to cover a portion of the first metal region 30*a* and a portion of the second metal region 30*b*; form a lower encapsulant layer 42 to cover a portion of the alloy layer 202, wherein at least one of the upper encapsulant layer 40 and the lower encapsulant layer 42 is substantially made of a flexible resin ink. The method of forming the upper encapsulant layer 40 and the lower encapsulant layer 42 may be but is not limited to be a screen-printing method. In one embodiment, the resistance of the micro-resistance structure is adjusted before the upper encapsulant layer 40 and the lower encapsulant layer 42 are formed. The method of adjusting the resistance of the micro-resistance structure may be but is not limited to be a grinding method, a laser method, or an etching method. The semi-finished structure of Step S40 is shown in FIG. 4E. The positions where the upper encapsulant layer 40 and the lower encapsulant layer 42 have been mentioned in Step S40 and will not repeat. In one embodiment, the flexible resin ink may be but is not limited to be a silicone resin ink, an epoxy resin ink, or a mixture of a silicone resin ink and an epoxy resin ink.

In Step S50, undertake a stamping process to form a plurality of micro-resistance structures 2, which are separated from each other. In Step S60, undertake an electroplating process to form in the micro-resistance structure 2 two external electrodes 50 and 52, which are electrically insulated from each other, as shown in FIG. 2A. The method of the present invention forms internal electrodes before formation of the patterns of the alloy layer and the metal layer, whereby to avoid undertaking etch before electroplating and prevent the resistors from conductor paralleling. Therefore, the present invention can effectively promote fabrication efficiency and reduce fabrication cost.

In conclusion, the present invention proposes a micro-resistance structure with high bending strength, a manufacturing method thereof, and a semi-finished structure thereof, wherein a special ink is used to increase the flexibility of the micro-resistance structure and promote the bendability of the micro-resistance structure, and wherein the internal electrodes are formed before formation of the patterns of the alloy layer and the metal layer to avoid undertaking etch before electroplating and prevent the resistors from conductor paralleling, whereby the fabrication efficiency is significantly promoted. Further, the present invention can effectively reduce cost via fabricating the patterns of the alloy layer and the metal layer simultaneously. Furthermore, the present invention makes the alloy layer have a width identical to that of the metal layer which can dissipate heat and thus allows the resistor to work at higher power.

What is claimed is:

1. A method for manufacturing a micro-resistance structure with high bending strength, comprising steps:

providing a multi-layer metallic substrate including an alloy layer, a resin layer disposed on an upper surface of said alloy layer, and a metal layer disposed on said resin layer;

forming an array of a patterned electrode layer on a lower surface of said alloy layer;

removing a portion of said multi-layer metallic substrate to form a plurality of micro-resistance units, which are partially separated, wherein in each said micro-resistance unit, said patterned electrode layer is defined to be a first electrode region and a second electrode region, which are separated from each other, and said metal layer further includes a first metal region and a second metal region;

forming an upper encapsulant layer to cover a portion of said first metal region and a portion of said second metal region, forming a lower encapsulant layer to cover a portion of said alloy layer, wherein at least one of said upper encapsulant layer and said lower encapsulant layer is substantially made of a flexible resin ink;

undertaking a stamping process to form a plurality of micro-resistance structures, which are separated from each other; and undertaking an electroplating process to form in said micro-resistance structure two external electrodes, which are electrically insulated from each other.

2. The method for manufacturing a micro-resistance structure with high bending strength according to claim 1, wherein said flexible resin ink is a silicone resin ink, an epoxy resin ink, or a mixture of a silicone resin ink and an epoxy resin ink.

3. The method for manufacturing a micro-resistance structure with high bending strength according to claim 1, wherein resistance of said micro-resistance structure is adjusted before said upper encapsulant layer and said lower encapsulant layer are formed, and wherein said resistance of said micro-resistance structure is adjusted with a grinding method, a laser method, or an etching method.

4. The method for manufacturing a micro-resistance structure with high bending strength according to claim 1, wherein in said step of removing a portion of said multi-layer metallic substrate, a portion of said alloy layer is removed to form a plurality of said micro-resistance units, which are partially separated, and a portion of said metal layer is removed to form said first metal region and said second metal region in each said micro-resistance unit.

5. The method for manufacturing a micro-resistance structure with high bending strength according to claim 4, wherein a portion of said metal layer and a portion of said alloy layer are removed simultaneously with an etching method.

6. The method for manufacturing a micro-resistance structure with high bending strength according to claim 4, wherein while a portion of said alloy layer is removed, at least one breach is formed in each said micro-resistance unit, and wherein said breach extends from a boundary of said alloy layer to a center of said alloy layer, and wherein said breaches parallel extend alternately from a left boundary and a right boundary of said alloy layer.

7. The method for manufacturing a micro-resistance structure with high bending strength according to claim 1, wherein each said micro-resistance structure has a bending depth of 2-10 mm, and wherein said bending depth is a depth of a center of said micro-resistance structure while said micro-resistance structure is bent by applying force to said center thereof with two sides thereof supported.

8. The method for manufacturing a micro-resistance structure with high bending strength according to claim 1, wherein said multi-layer metallic substrate is fabricated into an integral body with a hot-pressing technology.

9. The method for manufacturing a micro-resistance structure with high bending strength according to claim 1, wherein said patterned electrode layer is fabricated into an array on said lower surface of said alloy layer with an electroplating method.

10. The method for manufacturing a micro-resistance structure with high bending strength according to claim 1, wherein said upper encapsulant layer and said lower encapsulant layer are fabricated on said micro-resistance structure with a screen-printing method.

11. A semi-finished structure of a micro-resistance structure with high bending strength, comprising:

a multi-layer metallic substrate including an alloy layer, a resin layer disposed on an upper surface of said alloy layer, and a metal layer disposed on said resin layer; and an array of a patterned electrode layer disposed on a lower surface of said alloy layer; and at least one sub-metal layer disposed inside said resin layer.

12. The semi-finished structure of a micro-resistance structure with high bending strength according to claim 11, wherein a plurality of first perforated regions is formed in a portion of said alloy layer to form a plurality of micro-resistance units, which are partially separated, and wherein said patterned electrode layer is defined to be a first electrode region and a second electrode region in each said micro-resistance unit.

13. The semi-finished structure of a micro-resistance structure with high bending strength according to claim 12, wherein a plurality of second perforated regions is formed in a portion of said metal layer to form a first metal region and a second metal region in each said micro-resistance unit.

14. The semi-finished structure of a micro-resistance structure with high bending strength according to claim 13, wherein an upper encapsulant layer is formed to cover a portion of said first metal region and a portion of said second metal region, and a lower encapsulant layer is formed to cover a portion of said alloy layer, and wherein at least one of said upper encapsulant layer and said lower encapsulant layer is substantially made of a flexible resin ink.

15. The semi-finished structure of a micro-resistance structure with high bending strength according to claim 11, wherein said alloy layer includes at least one breach extending from a boundary of said alloy layer to a center of said alloy layer, and wherein said breaches parallel extend alternately from a left boundary and a right boundary of said alloy layer.

16. A micro-resistance structure with high bending strength, comprising:

a multi-layer metallic substrate structure including an alloy layer, a resin layer disposed on an upper surface of said alloy layer, and a metal layer disposed on said resin layer, wherein said metal layer further includes a first metal region and a second metal region;

a patterned electrode layer disposed on a lower surface of said alloy layer and defined to be a first electrode region and a second electrode region, which are separated from each other;

an upper encapsulant layer covering a portion of said first metal region and a portion of said second metal region, and a lower encapsulant layer covering a portion of said alloy layer and revealing said first electrode region and said second electrode region, wherein at least one of said upper encapsulant layer and said lower encapsulant layer is substantially made of a flexible resin ink; and two external electrodes electrically insulated from each other, wherein one of said two external electrodes covers exposed areas of said first metal region and said first electrode region, and another one of external electrodes covers exposed areas of said second metal region and said second electrode region; and at least one sub-metal layer disposed inside said resin layer.

17. The micro-resistance structure with high bending strength according to claim 16, wherein said flexible resin ink is a silicone resin ink, an epoxy resin ink, or a mixture of a silicone resin ink and an epoxy resin ink.

18. The micro-resistance structure with high bending strength according to claim 16, wherein said micro-resistance structure has a bending depth of 2-10 mm, and wherein said bending depth is a depth of a center of said micro-resistance structure while said micro-resistance structure is bent by applying force to said center thereof with two sides thereof supported.

19. The micro-resistance structure with high bending strength according to claim 16, wherein said alloy layer includes at least one breach extending from a boundary of said alloy layer to a center of said alloy layer, and wherein said breaches parallel extends alternately from a left boundary and a right boundary of said alloy layer.

* * * * *